United States Patent [19]

Chalin et al.

[11] Patent Number: 4,462,598

[45] Date of Patent: Jul. 31, 1984

[54] VANISHING TARGET AND ARROWHEAD PROJECTILE THEREFOR

[76] Inventors: Manuel L. Chalin, 1274 Pickens Ct., Yorktown Heights, N.Y. 10598; Philip J. Chalin, P.O. Box 122, Carmel, N.Y. 10592; Stuart A. Chalin, 1274 Pickens Ct., Yorktown Heights, N.Y. 10598

[21] Appl. No.: 330,783

[22] Filed: Dec. 14, 1981

[51] Int. Cl.[3] ..... F41J 3/00; F41B 5/02

[52] U.S. Cl. ..... 273/378; 273/408; 273/419

[58] Field of Search ..... 273/378, 407, 419, 420, 273/380, 393, 386, 408, 403, 404

[56] References Cited

U.S. PATENT DOCUMENTS

| | | | |
|---|---|---|---|
| 1,396,073 | 11/1921 | St. Pierre . | |
| 1,424,674 | 8/1922 | Orr . | |
| 1,789,575 | 1/1931 | Allen | 273/420 |
| 2,109,120 | 2/1938 | Price . | |
| 2,289,284 | 7/1942 | Chandler | 273/419 X |
| 2,535,280 | 12/1950 | Gartrell . | |
| 2,940,759 | 6/1960 | West . | |
| 3,122,367 | 2/1964 | Dale | 273/407 X |
| 3,353,827 | 11/1967 | Dun, Jr. | 273/378 |
| 3,682,478 | 8/1972 | Knight . | |
| 3,868,114 | 2/1975 | Groner | 273/419 |
| 3,895,803 | 7/1975 | Loe | 273/378 |
| 4,066,261 | 1/1978 | Stewart . | |
| 4,082,280 | 4/1978 | Lang . | |
| 4,243,228 | 1/1981 | Marcella | 273/378 |
| 4,247,116 | 1/1981 | McQuary . | |

OTHER PUBLICATIONS

Archer's Bible, 1966–1967, 3–1967, p. 53, "About Spine".

Archery, 1–69, p. 25, Converta–Points.

Archers Bible, 1966–1967, 3–1967, p. 80, HTM Blunt & S&R Blunt.

*Primary Examiner*—Paul E. Shapiro

*Attorney, Agent, or Firm*—Lowe, King, Price & Becker

[57] ABSTRACT

A target system includes a target sheet (10) comprising a polyester film (20) adhesively secured to a paper or polyethylene backing sheet (15). The polyester film (20) defines an exposed target surface (F) and includes a plurality of circular target strike zone portions (T) defined by spaced apart slits (S) perforating the polyester film (20). The circular target zone portions (T) are not adhesively secured to the backing sheet (15) and are integrally connected to the polyester film (20) with connecting portions (30) each located between adjacent slits (5). A rounded impact head (42) of a projectile (40) striking a target portion breaks the connecting portions (30), causing the target portion (T) to detach from the polyester film (20) and be pulled through the backing sheet (15) to achieve a vanishing effect. In another embodiment, separate zone portions (T) can be secured to the backing sheet with minute adhesive portions (25') or adhesive tape (32).

20 Claims, 6 Drawing Figures

Fig. 3
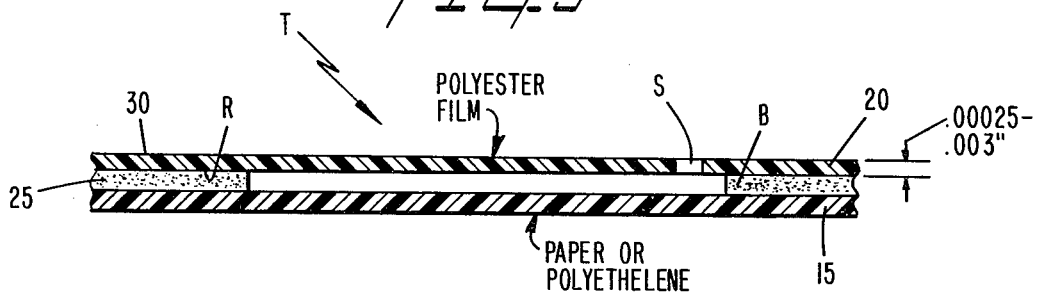
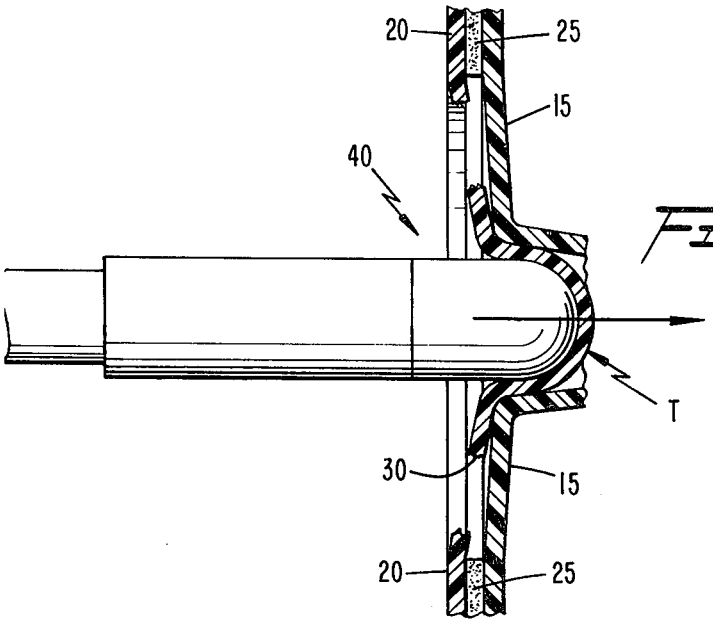
Fig. 4
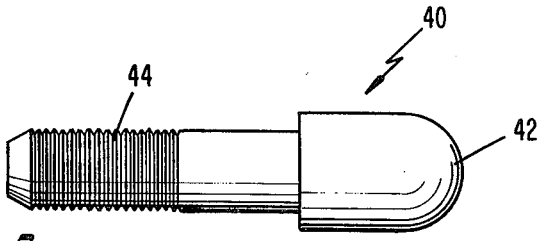
Fig. 5
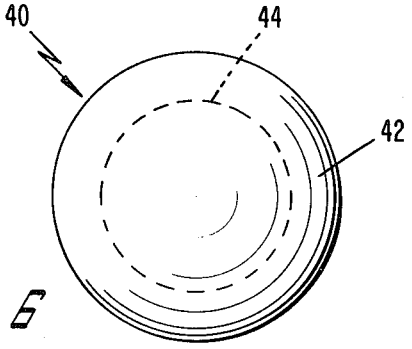
Fig. 6

VANISHING TARGET AND ARROWHEAD PROJECTILE THEREFOR

TECHNICAL FIELD

This invention relates generally to target apparatus and, more particularly, to a target sheet having vanishing target impact zones and a projectile therefor.

BACKGROUND ART

Various types of target sheets or apparatus such as paper targets are known for use with air guns, conventional firearms, archery equipment or other projectile shooting equipment. Generally speaking, projectiles such as BBs, bullets and the like do not leave a clearly visible marking after striking the paper target and other targets of which I am aware, thereby making it difficult to discern the precise impact area from a shooting or spectating distance.

it is accordingly an object of the present invention to provide a target sheet having improved visual effect characteristics leaving clearly visible markings of the impact areas.

Another object of the invention is to provide a target sheet wherein marksmanship can be easily and accurately perceived by both target shooting participants and spectators.

Yet another object is to provide a target wherein target zones struck by projectiles vanish from the target surface.

Additionally, such other targets of which I am aware, with the exception of paper targets, are relatively expensive to manufacture and usually require a high frequency of replacement.

Still a further object is to provide a target sheet that is economical to manufacture.

Another problem I have noted relates to the standardization of imprinted target surface areas and problems inherent therein. For example, most targets of which I am aware generally have imprinted thereon a plurality of concentric rings surrounding a centrally located bullseye. During shooting, the object is to strike the bullseye. Points are given to successful shooters; fewer points are given for striking other target zones defined within the concentric rings. However, since the objective is to place all the arrows in the relatively small bullseye area (e.g. three and one eighth inch diameter for a bullseye at twenty yards), the imprinted area tends to get blown away fairly rapidly, making it difficult to score. More importantly, because the arrows remain embedded in the target, they are often hit and damaged (e.g. split apart) by subsequent arrows shot at the target.

Yet another object of the present invention is to provide a target sheet that can sustain a high level of target use before replacement is required.

Still another object is to provide a target sheet having imprinted thereon different games both challenging and highly visible to the user and spectator.

A further object is to provide a target that assists in preventing damage to the arrows.

Most targets of which I am aware are also usually designed for penetration by specific types of projectiles. For example, paper or like target sheets are usually used in conjunction with BBs or bullets. Archery equipment and arrow projectiles cannot usually be used successfully with such target sheets to achieve the necessary visual or sound effect. Instead, relatively expensive and more sophisticated targets involving support structures are required for archery target shooting.

It is accordingly a further object of the present invention to provide an arrowhead projectile that can be used in connection with the target sheet of the invention for improved visual effect.

DISCLOSURE OF INVENTION

The target of the present invention comprises a substrate layer including a sheet of backing material substantially forming an overall target shape. Film layer means can be provided to at least partially cover the backing sheet and define an exposed target surface area. A substantially separate film portion of predetermined shape defines a target strike zone. Means is provided for positioning the film and target strike zones on the backing sheet. The target zone portion vanishes from the exposed target surface when struck by a substantially rounded portion of a projectile. Projectile impact causes the portion to be pulled through the backing sheet to achieve the vanishing effect.

Such film means preferably includes a layer of polyester film. Adhesvie material permanently secures the polyester film to the target sheet in areas outside the target zone portions; minute portions of adhesive material or adhesive tape secure the target zone portion to the target sheet in quantities insufficient to prevent the portions from being pulled through the target sheet during projectile impact.

In another embodiment, the portion is defined by a plurality of slits perforating the film means. The target zone portion is thereby integrally connected to the remaining polyester film by connecting portions located between adjacent slits and integral with the target zone portions and the polyester film to maintain the target portions in fixed position until struck by the projectile, whereupon the connecting portions break from the film so the target portions can be pulled through the target sheet.

An arrowhead projectile enabling use of archery arrows with the target sheet of the present invention is also disclosed. One end of the projectile includes a rounded impact head and the opposite end includes a threaded end portion which can be received in an arrow insert for attachment to an arrow shaft.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of instrumentalities and combinations particularly pointed out in the appended claims.

BRIEF DESCRIPTION OF THE DRAWING

FIG. 3 is a side, profile view taken through the line 3—3 of FIG. 2, showing location of adhesive material securing the target layers together;

FIG. 4 is a side profile view illustrating a target zone portion being struck by a projectile to achieve the vanishing effect;

FIG. 5 is a front plan view of an arrowhead projectile for use with the target sheet of the invention; and FIG. 6 is an end plan view of the prjectile shown in FIG. 5.

BEST MODE FOR CARRYING OUT THE INVENTION

Figure 1:
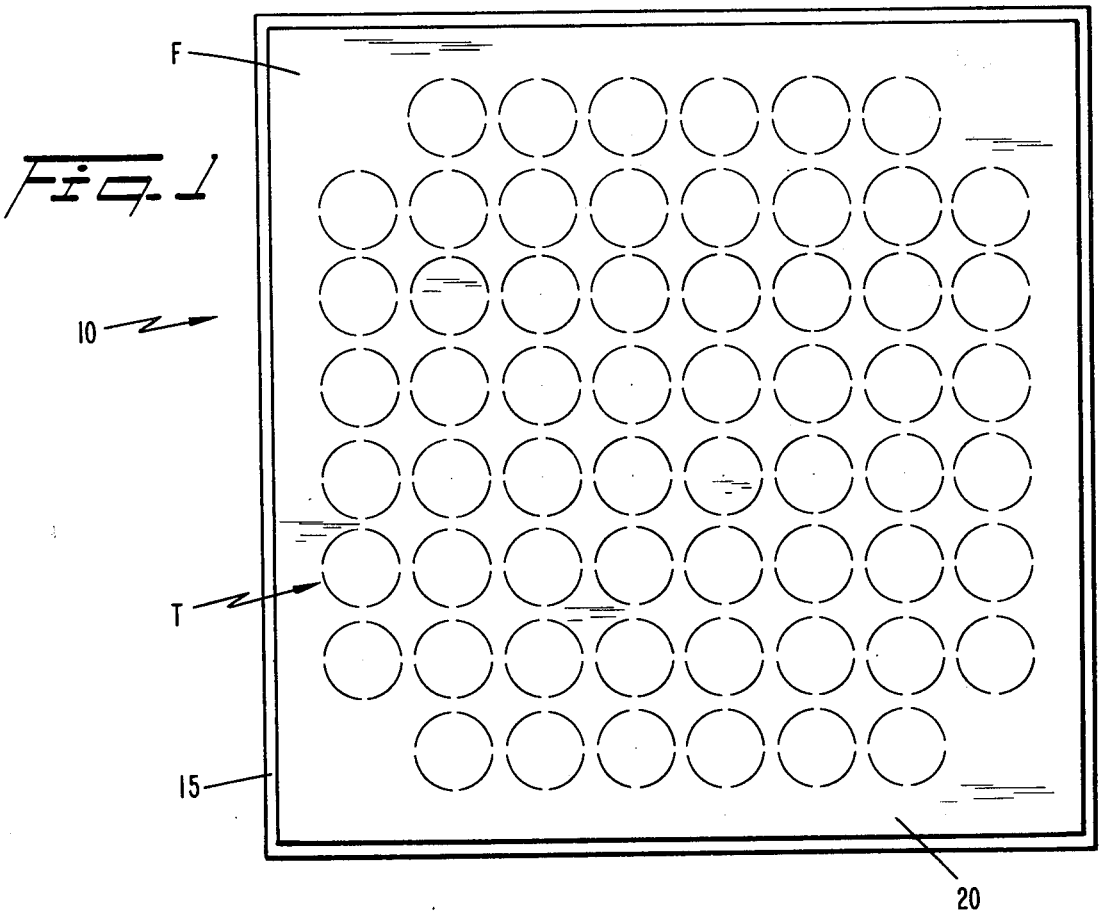
FIG. 1 is a front plan view of a preferred embodiment of the target sheet provided in accordance with the present invention.

Reference is now made to FIG. 1, wherein a preferred embodiment of target sheet 10 of the invention is shown to provide an overall, preferably rectangular target shape of suitable size that can be easily attached to a corrugated board (not shown) or other structure for target practice. A plurality of circular, target impact zone portions T provided on the exposed target face F of target sheet 10 vanish therethrough when struck by a projectile to achieve a vanishing effect, in accorcance with the unique and novel arrangement of materials set forth below.

As shown in FIG. 1, target sheet 10 includes a substrate layer preferably comprising a backing sheet 15 formed from paper or a polymeric layer such as polyethylene. Backing sheet 15 can be flexible to define the overall rectangular shape and can be easily rolled or folded for transportation or storage, and thereafter handled for easy set-up for target practice. Alternatively, backing sheet 15 can be formed from stiff corrugated material for durability. A backing sheet approximately eighteen inches square is usually sufficient to provide an overall target surface area for use at conventional target shooting distances.

A film layer means 20 substantially covers the sheet 15 to define an exposed target face F and target impact film zone portions T, as discussed more fully below. To achieve the intended vanishing effect of zone portions T through the target 10, and prevent the projectile from piercing the zone portions without pulling same through the target, film layer 20 must be formed from material having the necessary tensile strength characteristics resistant to projectile piercing.

Preferably, film layer 20 is formed from polyester film such as Mylar, manufactured and commercially available from DuPont Corporation, Wilmington, Del. The preferred thickness of the polyester film is approximately 0.00025 to 0.003 inch.

The polyester film 20 is secured to backing sheet 15 with known conventional adhesive materials, such as glue, forming adhesive layer 25 between the polyester and backing sheet. As best shown in FIG. 3, to ensure proper vanishing effects, adhesive layer 25 is usually not applied between target zone portions T and backing sheet 15; however, other embodiments are presented herein requiring adhesive material to secure the zone portions to the backing sheet 15 or film layer 20, as discussed more fully below. Furthermore, adhesive layer 25 does not secure peripheral portions of film 20 surrounding each zone portion T to the backing sheet. A peripheral border B of approximately one-sixteenth inch around each portion T is preferred, wherein adhesive material is not disposed to prevent material from creeping between the portions and backing sheet and thereby degrading the vanishing effect.

Preferably, to ensure rapid and relatively inexpensive production, the rear surface R facing backing sheet 15 can be coated with heat sensitive material during production; thereafter, heat can be selectively applied, as above, to secure film 20 to backing sheet 15 in areas outside of portions T.

Figure 2:
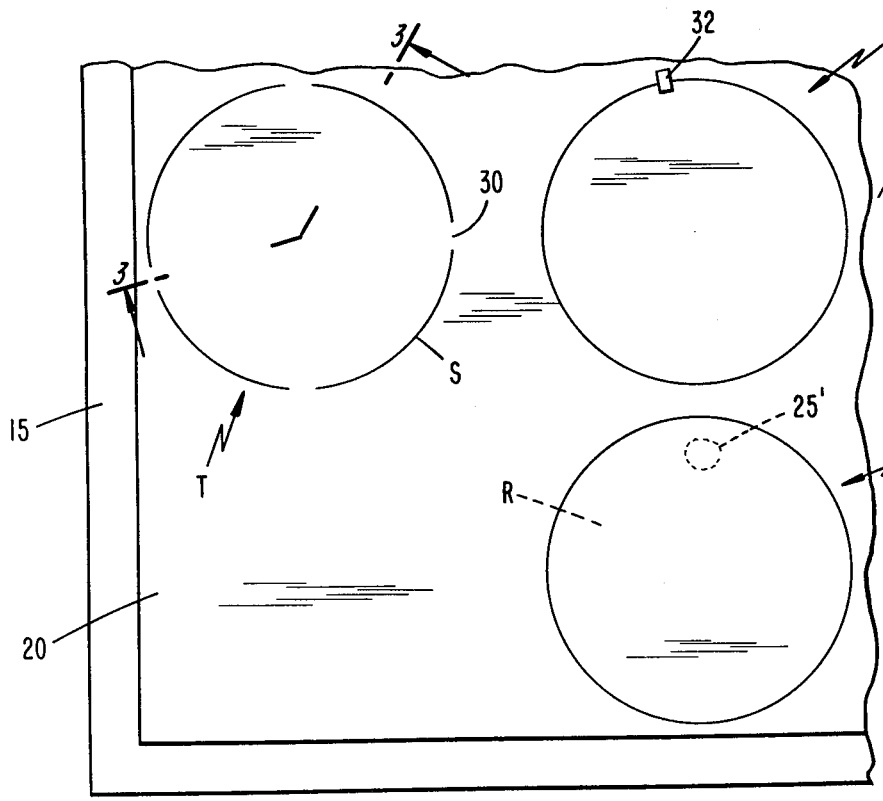
FIG. 2 is an enlarged front plan view of various target strike zone portions provided on the target sheet to illustrate different means for securing the portions to the sheet.

In the preferred embodiment, each target zone portion T is defined by a plurality of arcuate openings or slits S perforating film layer 20, as best shown in FIG. 2. Slits s are formed, for example, by die-cutting the film layer prior to adhesively securing film to backing sheet 15. Preferably three or four equi-spaced slits S peripherally define each target portion T.

Each target portion T is maintained in fixed position on backing sheet 15 with film connecting portions 30. Each portion 30 is located between adjacent slits S in equi-spaced relationship with other connecting portions common to one of portions T. The width of each portion 30, being defined as the distance between adjacent ends of an adjacent pair of slits S, is preferably three-sixteenths inch or less to securely maintain the target portions T on the target and thereafter rupture or tear during projectile impact to achieve the vanishing effect, as shown in FIG. 4.

As defined above, each target zone portion T can be approximately two to three and one-half inches in diameter and is advantageously capable of detaching from film layer 20 upon projectile impact subsequent to rupturing of connecting portions 30. Due to the tensile strength characteristics of the film, in particular those characteristics of polyester film, such as Mylar, and the connecting characteristics provided by the connecting portions 30, the portions T will vanish from target face F if sufficient space is provided behind the target by being pulled through backing sheet 15 upon impact by the projectile (see FIG. 4) leaving exposed an area of the backing sheet formerly underlying the vanishing target portion.

FIG. 2 illustrates other means for securing the target portions to backing sheet 15. For example, film portions T′ can be provided in lieu of portions T as entirely separate portions from film layer 20. In this embodiment, connecting portions 30 are not required; instead, a piece of adhesive tape 32 can be used to secure portions T′ to film layer 20. Alternatively, the separate film portions T′ can be secured directly to backing sheet 15 with a minute portion 25′ of adhesive material applied to rear surface R.

In view of the different aforesaid positioning means for positioning portions T′ on backing sheet 15, it will be appreciated that the invention is also capable of reliable and challenging use without film layer 20 since portions T′ can be positioned directly on backing sheet 15.

To achieve maximum visible effect subsequent to vanishing of target zones T, backing sheet 15 and target face F are preferably colored or mat finished differently from each other to provide high visual contrast. Alternatively, where use of portions T′ is contemplated without a surrounding film layer 20, as aforesaid, appropriate contrast between areas of backing sheet 15 surrounding the areas of the backing sheet underlying the portions T′, prior to projectile impact, is desirable, to achieve the aforesaid contrast after projectile impact.

A projectile having a rounded impact head is preferably used to shoot zone portions T out of target 10. High velocity impact between the rounded head and portion T evenly distributes tension created upon impact through the film layer of the target portion to each of connecting portions 30, causing each connecting portion to break or rupture. Continued forward movement of the projectile thereupon pulls portion T through backing sheet 15 to cause the vanishing effect therebetween, without piercing the portion.

While BBs, balls, bullets and darts with rounded impact heads thrown or discharged with air guns and conventional firearms can be used successfully with target 10 of the invention, I have also provided an arrowhead projectile 40 enabling use of the target with archery equipment. As shown in FIGS. 5 and 6, projectile 40, formed preferably from steel, includes a semi-spherical rounded impact head 42 having a diameter of approximately five-sixteenth inch. A threaded end 44 projects rearwardly from the head 42, in longitudinal alignment therewith, for threaded engagement with a known arrow insert (not shown) for attachment to the forward end of commercially available arrow shafts 42A (see FIG. 4). Both the arrow insert and arrow shaft can be purchased, for example, from Easton Incorporated, 7800 Haskell Avenue, Van Nuys, Calif. 91406.

With target 10 of the present invention, it will now be obvious that various types of target games can now be easily and economically fabricated. For example, each of target portions T can be differently colored by printing with a mat finish to achieve a game of archery pool, with each player or team taking turns at shooting in accordance with conventional or modified billiard rules. The vanishing effect of the portions T achieved with the invention, as discussed above, is highly stimulating and challenging to the participants, and also provides for improved and exciting visual observation by spectators. In addition, target portions T can be formed in other shapes, such as pie or animal shapes, to achieve a variety of other games or vanishing effects.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A target, comprising:

(a) a substrate means including a sheet of backing material substantially forming an overall target shape, said substrate means permitting a projectile to penetrate therethrough;

(b) a film layer means at least partially covering the backing sheet, said film layer means defining an exposed target surface and including a film portion of predetermined shape defining a target strike zone and being impenetrable by the projectile, said film portion forming part of the exposed target surface, whereby said projectile impact causes said portion to be pulled through the backing sheet to thereby vanish from the exposed target surface; and (c) means for positioning the film portion on the backing sheet, said positioning means being operable to permit seperation of said film portion from the remainder of said exposed target surface when struck by the projectile.

2. A target according to claim 1, wherein said film layer means includes a layer of polyester film.

3. A target according to claim 2, wherein said film portion is substantially a separate film portion from the film layer means.

4. A target according to claim 3, wherein said positioning means includes a small amount of adhesive material securing the separate film portion to the backing sheet, said adhesvie material covering only a portion of the film portion surface area facing the backing sheet.

5. A target according to claim 2, wherein said positioning means includes a connecting portion integrally formed with said film portion to interconnect the film portion to said film layer means.

6. A target according to claim 4 or 5, wherein said polyester film is of a substantially uniform thickness within a predetermined range to achieve tensile strength characteristics enabling same to vanish from the exposed target surface without being pierced by the projectile.

7. A target according to claim 6, wherein said predetermined thickness range is approximately 0.00025 inch to 0.003 inch.

8. A target according to claim 6, wherein said positioning means includes adhesive material securing the film layer means to the backing sheet.

9. A target according to claim 8, wherein said film layer means includes a plurality of target zone film portions of substantially circular shape spaced from each other on the backing sheets.

10. A target according to claim 5, further including adhesive material being applied to a rear surface of the polyester film adapted to face the backing sheet only in areas outside said target zone film portion.

11. A target according to claim 10, wherein said adhesive material is applied to the film layer means only in areas outside said target zone portions at least approximately one-sixteenth inch away from said portions.

12. A target according to claim 5, wherein said positioning means includes heat sensitive adhesive material applied to a rear surface of the target film portion and film layer means, heat being selectively applied to cause the film layer means to adhere to the backing sheet in areas outside the film portion.

13. A target according to claim 2, wherein said backing sheet is formed from paper or polyethylene.

14. The target of claim 13, wherein said film portion remains substantially intact when pulled through the backing sheet upon impact with the projectile.

15. A target system, comprising:

(a) projectile means having a rounded impact head;

(b) a sheet of backing material penetrable by the projectile means;

(c) polyester film means at least partially covering the backing sheet, said polyester film means defining an exposed target surface and including a portion of predetermined shape defining a target zone, said portion being defined by an opening perforating the film means and means permitting separation of said portion from the remainder of said exposed target surface when struck by the projectile means, said portion being impenetrable by the projectile means, said projectile causing said portion to detach from the polyester film means and be pulled through the backing sheet to thereby vanish from the exposed target surface; and (d) means for securing the film means on the backing sheet.

16. A target according to claim 15 wherein said opening includes a plurality of substantially identical slits surrounding said target zone portion, said slits being substantially equi-spaced from each other to define said separation means being equi-spaced connecting portions integrally formed between the target zone portion and film means to thereby connect said target portion to said film means.

17. A target according to claim 16, wherein said connecting portions are each approximately three-sixteenths inch in length.

18. A target, comprising:

(a) substrate means including a sheet of backing material substantially forming an overall target shape and defining an exposed target surface being penetrable by a projectile;

(b) at least one film portion of predetermined shape positioned on the exposed target surface and forming part of the surface, said portion being impenetrable when struck by a substantially rounded impact head of a projectile, said projectile causing said film portion to be pulled through the backing sheet to thereby vanish from the exposed target surface; and (c) means for fastening the film portion on the substrate means, said means permitting separation of said portion from the remainder of the exposed target surface when struck by the projectile.

19. A target according to claim 18, wherein said film portion includes a layer of polyester film.

20. The target of claim 18, wherein said film portion has a diameter larger than the diameter of the projectile head.

* * * * *